United States Patent [19]

Stewart

[11] Patent Number: 4,603,443

[45] Date of Patent: Aug. 5, 1986

[54] TOILET WITH SIGHT GAUGE

[75] Inventor: John M. Stewart, Ontario, Canada

[73] Assignee: Sanitation Equipment Limited, Concord, Canada

[21] Appl. No.: 658,939

[22] Filed: Oct. 9, 1984

[51] Int. Cl.[4] ..... E03D 1/00; E03D 3/00; E03D 5/00

[52] U.S. Cl. ..... 4/314; 4/321; 4/353; 4/300; 4/661; 73/330; 73/334; 116/227; 137/558

[58] Field of Search ..... 4/300, 315, 314, 317, 4/318, 319, 321, 323; 73/330, 293, 327, 331, DIG. 5, 334; 116/227; 137/65, 558

[56] References Cited

U.S. PATENT DOCUMENTS

| | | | |
|---|---|---|---|
| 2,917,924 | 12/1959 | Messick | 116/227 X |
| 3,241,369 | 3/1966 | Wizenbeek | 116/227 X |
| 3,727,242 | 4/1973 | Miller | 4/314 |
| 3,949,430 | 4/1976 | Miller et al. | 4/321 |
| 4,164,197 | 8/1979 | Nelson | 116/227 |
| 4,363,240 | 12/1982 | Mizusaki | 116/227 X |
| 4,376,490 | 3/1983 | Mizusaki | 116/227 X |
| 4,547,916 | 10/1985 | Henke et al. | 4/321 X |

*Primary Examiner*—Henry K. Artis
*Attorney, Agent, or Firm*—Rogers, Bereskin & Parr

[57] ABSTRACT

A two-piece portable toilet having sight gauges for the flush water reservoir and holding tank. The sight gauge takes the form of a translucent plastic insert having a highlight formed by a diametral groove which permits the liquid level to be clearly ascertained. The inserts are sealed by induction welding in openings in the wall of the reservoir and holding tank respectively.

5 Claims, 4 Drawing Figures

FIG. 3
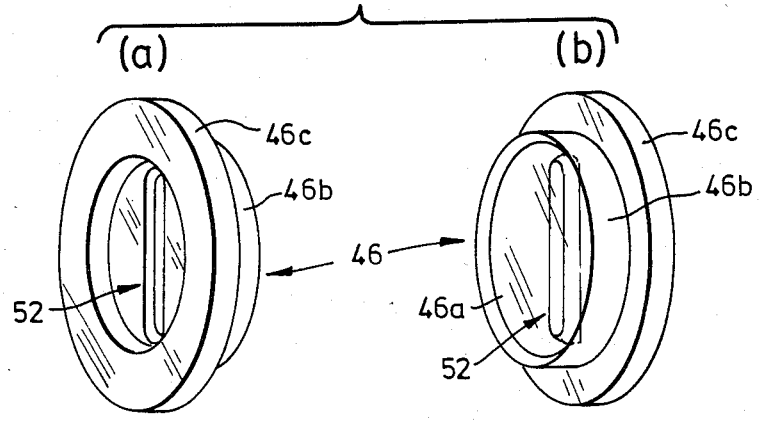
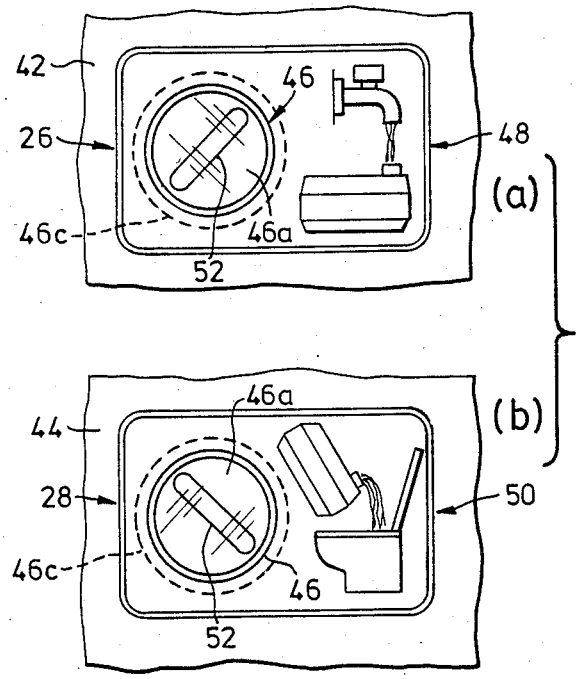
FIG. 4

TOILET WITH SIGHT GAUGE

BACKGROUND OF THE INVENTION

1. Field of the Invention

This invention relates generally to toilets and is concerned primarily (but not exclusively) with toilets of the type known as "two-piece portable toilets".

Typically, a two-piece portable toilet comprises a bowl unit detachably secured to and supported by a holding tank. The bowl unit includes a bowl having a discharge outlet which communicates with an inlet at the top of the holding tank. The bowl unit incorporates a flush liquid reservoir formed around the bowl and a manually operable pump for discharging flush liquid into the bowl. The holding tank is provided with a valve mechanism which normally closes the holding tank inlet but which can be opened to allow waste to enter the holding tank from the bowl.

Each time the toilet is used, liquid passes from the flush liquid reservoir into the holding tank and the level of liquid in the reservoir falls while the level in the holding tank rises. The bowl unit is provided with a liquid inlet through which the reservoir can be periodically refilled and the holding tank is designed to be detached from the bowl unit so that it can be periodically emptied.

Determination of the times at which the reservoir should be refilled and the holding tank emptied has generally been left to visual observation by the user, of the flushing action of the toilet. When an attempt is made to flush the toilet but flush liquid does not appear, then the reservoir is refilled. In the case of the holding tank, visual observation through the discharge outlet of the bowl when the holding tank valve is open is used to determine the point at which the holding tank should be emptied.

2. Description of the Prior Art

Proposals have been made to provide the holding tank with a visual indicator for signaling when the holding tank is full. For example, U.S. Pat. No. 3,727,242 (Miller) shows an example of a liquid level indication apparatus in a recirculation-type toilet. This type of toilet has a holding tank from which liquid is recirculated through the bowl of the toilet and back into the tank. In the patented structure, a vertical slot is provided in the wall of the tank extending from the level of the inlet of a recirculation pump to the level of the bowl outlet, and a clear plastic prism is mounted in the slot and allows the liquid level to be monitored by viewing through the prism. While this form of indicator has the advantage of an absence of moving parts, it would have a serious aesthetic drawback in that the contents of the holding tank would be visible through the prism. Also, the indicator would be relatively expensive to manufacture both in terms of the cost of the components and the difficulty of forming a slot in the wall of the holding tank and sealing the prism in liquid-tight fashion in the slot.

Another form of liquid level indicator which has been used in the waste holding tank of a two-piece portable toilet involves a float which responds to the liquid level in the holding tank and which is used to turn an indicator drum located in an opening in the wall of the tank. The float is enclosed in a plastic bag which is sealed to the wall of the holding tank around the opening in which the drum is located. As the level of liquid within the holding tank rises, the float also rises inside its plastic bag until a maximum level is reached; the drum is marked to then indicate that the holding tank should be emptied.

This form of indicator suffers from a number of disadvantages, most of which stem from the fact that moving parts are involved. The float is prone to jam, for example due to the presence of tissue in the holding tank and/or to the presence of the plastic bag surrounding the float. Also, this form of indicator is quite costly to manufacture, again not only because of the cost of the components of the indicator, but also because of the difficulty of effectively sealing the float assembly against leakage.

BRIEF SUMMARY OF THE INVENTION

An object of the present invention is to provide an improved liquid level indicator arrangement for a toilet.

In one aspect, the invention provides a toilet having a bowl for receiving waste and at least one tank forming either a holding tank for receiving waste from the bowl or a reservoir for containing flushing liquid to be delivered to the bowl, wherein the tank has an external wall which is provided with a liquid level indicator visible at the exterior of the toilet and comprising a sight gauge in the form of an insert sealed in an opening in the tank wall. The insert is positioned in the wall at a height selected to correspond with a critical liquid level in the tank at which the tank should be refilled where the tank is a reservoir or emptied where the tank is a waste holding tank. The insert is adapted to permit the level of liquid in the tank to be observed from externally of the toilet at the critical liquid level and sufficiently in advance of the level to provide a user with a warning that the critical level is being approached. The insert is made of a translucent material preventing clear viewing of the interior of the tank and is provided with a highlight formed by an elongate strip of reduced thickness compared with the remainder of the insert, which strip is oriented so that the surface of liquid extends transversely of the strip.

In practice, it is found that the presence of a strip of reduced thickness of the form defined above acts to "highlight" or emphasize the actual level of the liquid and provide a very clearly visible level indication.

An at least partially transparent disc-shaped insert may be used. The insert should be positioned in the wall at a height selected so that the centre of the disc substantially coincides with a critical liquid level in the tank at which the tank should be refilled where it is a reservoir or emptied where it is a waste holding tank. The insert is adapted to permit the level of liquid in the tank to be observed from externally of the toilet at the critical liquid level and sufficiently in advance of the level to provide a user with a warning that the critical level is being approached.

A disc form insert has the advantage that it can be sealed into a circular opening drilled in the relevant wall of the toilet tank, which makes for ease of manufacture as compared with other shapes of holes which might have to be specially die-cut or moulded into the wall (e.g. as in the case of the prism disclosed in U.S. Pat. No. 3,727,242 - Miller).

The present invention has been devised primarily for use in the environment of portable toilets but may be used in any form of toilet having either a waste holding tank or a tank forming a reservoir for flushing liquid.

The toilet may be a two-piece portable toilet comprising a bowl unit detachably secured to and supported by a holding tank. The bowl unit includes a bowl having an outlet which communicates with an inlet at the top of the holding tank and incorporates a tank forming a reservoir for flushing liquid. Each of the said tanks has an external wall which is provided with a liquid level indicator visible at the exterior of the toilet and comprising a sight gauge in the form of an at least partially transparent insert sealed in an opening in the tank wall, the insert being positioned in the wall at a height selected to correspond with a critical liquid level in the tank. In the case of the flushing liquid reservoir, this critical liquid level is the level at which the tank should be refilled and in the case of the holding tank it is the level at which the tank should be emptied. Each of the inserts is adapted to permit the level of liquid in the associated tank to be observed from externally of the toilet at the critical liquid level and sufficiently in advance of the level to provide a user with a warning that the critical level is being approached.

Preferrably, the insert is made of a translucent material. Accordingly, light admitted by the insert is diffused so that the contents of the relevant tank cannot be clearly distinguished. This avoids the unsightly effect which would occur if an observer were to be able to clearly see the contents of the tank, particularly in the case of the waste holding tank.

It has also been found that the liquid level within the relevant tank can be clearly ascertained if the insert is provided with a highlight formed by an elongate strip of reduced thickness compared with the remainder of the insert, which is oriented so that the surface of the liquid in the tank extends transversely of the strip. The reduced thickness of the strip allows a narrow band of liquid to be seen more clearly than elsewhere behind the insert. The strip is preferably quite narrow (e.g. 0.150" wide) so that only a correspondingly narrow band of liquid can be seen clearly.

BRIEF DESCRIPTION OF THE DRAWINGS

In order that the invention may be more clearly understood, reference will now be made to the accompanying drawings which illustrate a preferred embodiment of the invention by way of example, and in which:

FIG. 3 comprises front and rear perspective views denoted 3*a* and 3*b* respectively of the sight gauge shown in FIG. 2; and, FIG. 4 comprises two front elevational views denoted respectively 4*a* and 4*b* showing the two sight gauges of the toilet of FIG. 1.

DESCRIPTION OF THE PREFERRED EMBODIMENTS

Figure 1:
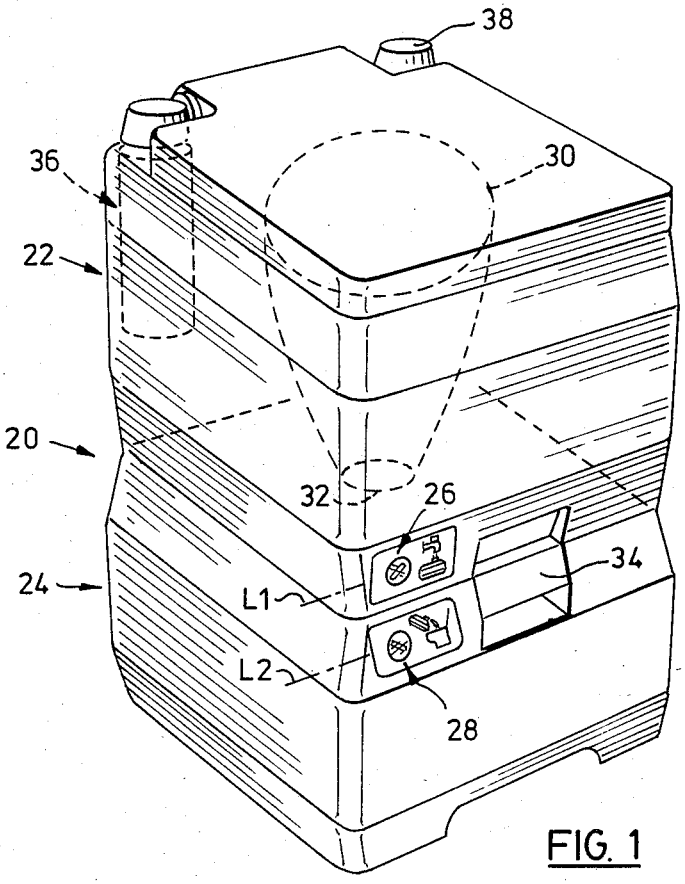
FIG. 1 is a perspective view from the front of a two-piece portable toilet provided with liquid level indicators in accordance with the invention.

Referring first to FIG. 1, a two-piece portable toilet is generally denoted by reference numeral 20 and is shown to comprise a bowl unit 22 detachably secured to and supported by a holding tank 24. The bowl unit and holding tank incorporate respective sight gauges generally denoted 26 and 28, which will be more specifically described later. Apart from these sight gauges, the remainder of the toilet is essentially of known construction and will not, therefore, be described in detail. For example, the toilet (apart from the sight gauges) may be of the form sold under the trade mark PASSPORT or VISA by Sanitation Equipment Limited of Ontario, Canada.

For present purposes, it is sufficient to note that bowl unit 22 includes a bowl indicated in dotted outline at 30 which has a discharge outlet 32 arranged to co-operate with an inlet (not shown) of the waste holding tank. That inlet is controlled by a valve mechanism (also not shown) which can be operated by an actuating handle 34. Reference may be had to U.S. Pat. No. 4,439,875 (Stewart), the disclosure of which is incorporated herein by reference, for details of the valve mechanism and the manner in which the bowl unit and holding tank are detachably secured together.

Bowl unit 22 is essentially a tank which is moulded in a plastic material and fitted internally with a moulding which defines the bowl 30. The space around the bowl within the tank defines a reservoir for flushing liquid. A manually operable pump unit 36 extends down into the reservoir and can be operated to discharge liquid from the tank into the bowl, all in known manner. The reservoir can be filled through a spout which is normally closed by a removable cap indicated at 38.

Bowl unit 22 is completed by a hinged plastic lid 40 which can be moved between the closed position in which it is shown in FIG. 1 and an open position in which the bowl 30 is exposed for use.

Typically, the bowl unit will be assembled from one or more mouldings in a suitable thermoplastic material which are sealed together in liquid-tight fashion. For example, the mouldings may be injection moulded in high-impact polypropylene.

Similarly, waste holding tank 24 will be assembled from at least two plastic mouldings sealed together. The valve assembly referred to above will be manufactured separately and secured to the top of the waste holding tank. The tank will also include a spout for emptying purposes which will normally be closed by a cap. Again, details of the emptying spout and cap have not been shown.

FIG. 4 shows enlarged elevational views of the two sight gauges 26 and 28. Portions of the walls of the respective tanks forming the reservoir for flushing liquid and waste holding tank are indicated at 42 and 44 respectively. Each wall portion is formed with a circular opening which receives an insert 46 of the form shown in FIG. 3. FIG. 3*a* shows the insert as seen from the rear face; that is, the face which is inside the relevant tank while FIG. 3*b* shows the external face of the insert which is visible at the exterior of the toilet. It is this exterior face, denoted 46*a*, which is seen in FIGS. 4*a* and 4*b*. In the vicinity of each of the inserts 46 the wall portions 42 and 44 are provided with graphics generally indicated at 48 and 50 respectively which are intended to illustrate to a user of the toilet the function of each of the sight gauges. Thus, the graphics denoted 48 show that the flushing liquid reservoir should be refilled when liquid reaches a critical level within sight gauge 26 while graphics 50 illustrate emptying of the waste holding tank when that sight gauge is seen to show a critical level. The graphics may be printed onto transparent films adhesively secured to the respective wall portions 42 and 44.

The two inserts 46 are essentially identical except in that they are differently coloured as will be more specifically described later. The insert are injection moulded in a translucent thermoplastic material, in this case polypropylene. Referring to FIG. 3, insert 46 is generally disc-shaped and includes a circular centre portion **46*b* and a flange 46*c* which surrounds portion 46*b* at one end thereof. The exterior surface 46*a* of the insert is at the opposite end of this centre portion. The insert is fitted into a circular opening in the relevant tank wall which is dimensioned to closely receive the centre portion 46*b* so that the inner surface of flange 46*c* can be sealed against the relevant surface of the tank wall around the opening therein. As indicated previously, flange 46*c*** will be sealed onto the interior surface of the tank wall.

It will be seen from FIG. 3(*a*) that the interior surface of centre portion **46*b* is recessed with respect to flange 46*c* and provided with a highlight denoted 52 formed by an elongate strip of reduced thickness compared with the remainder of the centre portion of the insert. In this embodiment, the strip is formed by a groove which extends over substantially the entire length of a diameter of the circular centre portion 46*b* of insert 46** and over approximately half the depth of the centre portion.

By way of example, the wall thickness of the centre portion may be approximately 0.130" and groove 52 may be of approximately 0.060" in depth. The width of groove 52 may be 0.150". The wall thickness of the flange **46*c* may be 0.100" and the overall diameter of the insert at the flange may be 1.25". The centre portion 46*b*** may be 1" in diameter.

Referring back to FIG. 4, the inserts 46 are sealed into the respective tank walls with the highlight 52 of each insert oriented so that the surface of liquid in the tank behind the insert extends transversely of the groove forming the highlight. While the inserts could be oriented with the grooves vertical, it has been found preferable to incline the highlights somewhat and to arrange for the highlights of the respective liquid level indicators to be oppositely inclined as shown in FIG. 4. This provides for a clear visual contrast between the two indicators when the toilet is in use.

As noted previously, each of the inserts is moulded in a translucent plastic material. This fact, coupled with an appropriate selection of the wall thickness of the centre portion of the insert means that ambient light which is incident on the insert is diffused so that the liquid within the relevant tank cannot be clearly seen. This is particularly important in the case of the waste holding tank where it would be aesthetically unpleasant for users of the toilet to be able to see the contents of the tank. The highlight 52 formed by the groove in the insert reduces the extent to which the liqht is diffused sufficiently to permit the liquid level behind the highlight to be clearly seen. In this way, the liquid level can be clearly ascertained at all times but without the unsightliness which would result from having the contents of the holding tank visible. It has been found that this effect can be further enhanced by appropriately colouring the insert for the waste holding tank. Normal practice is to add to the waste holding tank a deodorizing chemical which happens to be coloured blue. It has been found that, by colouring the insert 46 a light pink colour the dark blue of the deodorizing chemical results in a very clearly visible liquid level indication in the insert 46. The insert for the flushing liquid reservoir is uncoloured and is milky white in appearance which provides for further contrast between the two sight gauges.

Referring back to FIG. 1, it will be seen that the two sight gauges 26 and 28 are positioned respectively in a lower region of the bowl unit 22 and in an upper region of the waste holding tank 24. Specifically, the inserts 46 forming the sight gauges are each positioned at a height in the wall of the relevant tank selected to correspond with a critical liquid level in the tank. In the case of the flushing liquid reservoir, the critical level is that at which the reservoir requires refilling while in the case of the waste holding tank 24 the critical level is the level at which the tank should be emptied. Those levels are denoted respectively at L1 and L2 in FIG. 1. The inserts 46 are positioned with their centres substantially coincident with the respective levels. Referring back to FIG. 4, it will be seen that the levels (which are also indicated at L1 and L2 respectively in those views) can be observed from externally of the toilet through the inserts 46 and that the actual liquid level can be observed sufficiently in advance of the critical level to provide a user with a warning that the critical level is being approached. As noted above, in the present embodiment, a diameter of 1" has been selected as an appropriate diameter for the centre portion of the insert which is visible at the exterior of the toilet, to provide for a sufficient advance warning that the critical level is being approached.

Figure 2:
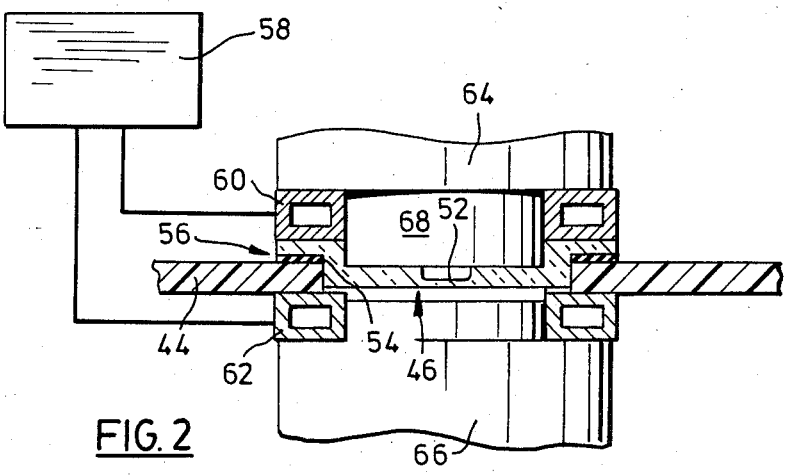
FIG. 2 is a somewhat diagrammatic sectional view through one of the sight gauges used in the toilet of FIG. 1 and illustrates the manner in which the sight gauge is sealed into an opening in the wall of the relevant tank.

FIG. 2 illustrates the method by which the inserts 46 are sealed into openings in the walls of the respective tanks. FIG. 2 may be considered to be a diametral section through one of the inserts 46 shown located in an opening in a wall of one of the two tanks of the toilet; in this case, it is assumed that the wall portion shown in FIG. 2 is portion 44 of the waste holding tank (see also FIG. 4). The opening in the tank wall is denoted 54 and the insert 46 is shown positioned with its circular central portion **46*b* located in that opening and its flange 46*c* at the inner side of the wall. Interposed between that flange and the inner surface of the wall is a gasket 56** of a plastic material having magnetically excitable particles dispersed therein. The plastic material will normally be the same as that from which the insert and tank moulding are made (polypropylene). A suitable material is commercially available as E.M.A. PP03H calandered stock from EMA Corporation of New Jersey.

Having assembled the tank and insert in this way, the gasket 56 is subjected to the effect of a high frequency magnetic field having characteristics selected to excite the particles in the gasket to an extent sufficient to cause the opposed faces of flange **46*c* and the inner surface of the tank wall to fuse around opening 54. The magnetic field is applied by means of a conventional radio frequency generator of the type used for induction welding. The generator is indicated generally by reference numeral 58 in FIG. 2 and includes an induction coil (not shown) in which a radio frequency magnetic field is induced. The magnetic field is applied to gasket 56 by way of two transmission heads 60 and 62 applied to opposite sides of the assembly comprising insert 46 and the tank. Thus, as shown, head 60 is applied to the outer surface of insert flange 46*c* while head 62 is applied to an aligned portion of the outer surface of the tank wall 44. The two heads are carried by respective jigs 64 and 66 which support the heads. Jig 64 also includes a mandrel portion 68 which locates against the inner surface of the centre portion 46*b*** of the insert.

The heads 60 and 62 are in the form of rectangular section copper tube each formed into an annular configuration. Cooling water can be circulated through the tubes if required. The respective heads are coupled to the generator 58 so that the generator produces a magnetic field between the heads which is applied to the gasket 56 for a period of time sufficient to cause the gasket to melt and fuse with the adjacent faces of flange 46*c* and wall portion 44. In one particular example, a frequency of 7,000 c.p.s. was found to be appropriate and was applied for an appropriate period of time determined by experimentation to cause the required fusion without thermally damaging the insert or tank. The fusion process has been found to in effect cause the flange of insert 46 and the adjacent tank wall portion to integrally fuse and form a perfectly liquid-tight seal.

As noted above, the respective tanks are each made from two or more plastic mouldings which are sealed together in manufacture. Normally, it will be convenient to seal the inserts 46 in place before this step is completed. At this time, the mouldings which form each tank are separate and can be individually manipulated and the moulding which is to receive the insert can be appropriately supported for drilling of hole 54 and then located on jig 66 and fitted with an insert. The insert can then be sealed in place by the process described. Normally, jig 66 will be stationary and jig 64 will be carried by a press arrangement designed to allow jig 64 to be moved towards and away from jig 66 and to apply the transmission head 60 against insert 46 under slight pressure to assist in forming the weld between the insert and tank wall.

In summary, the invention provides, for either the holding tank or flush liquid reservoir, or both, of a toilet, a sight gauge arrangement which allows the liquid level(s) to be supervised in a reliable way without encountering the problems caused by indicators which involve the use of moving parts and without the use of potentially unsightly "windows" in the tank walls. As noted previously, the invention may be applied to many different forms of toilet and is not limited to two-piece portable toilets. Also, the sight gauge itself need not be of the specific form shown in the drawings. Different materials could also of course be used and the sight gauge could be secured in place other than by the induction welding method described above (although that method is believed to be preferred). The sight gauge could even be transparent when used for a flush liquid tank or if made sufficiently small to avoid exposing the contents of the holding tank.

I claim:

1. A toilet which includes a bowl for receiving waste and at least one tank forming either a holding tank for receiving waste from the bowl, or a reservoir for containing flushing liquid to be delivered to the bowl, wherein the tank has an external wall which is provided with a liquid level indicator visible at the exterior of the toilet and comprising a sight gauge in the form of an at least partially transparent disc-shaped insert having a centre portion of circular shape received in a complementary opening in a wall of the tank, and a surrounding flange sealed to said wall, said insert being positioned in said wall with its centre at a height selected to substantially coincide with a critical liquid level in the tank at which the tank should be refilled where the tank is a reservoir or at which the tank should be emptied where the tank is a waste holding tank, said insert being adapted to permit the level of liquid in the tank to be observed from externally of the toilet at said critical level and sufficiently in advance of said level to provide a user with a warning that the critical level is being approached, said insert being made of a translucent material preventing clear viewing of the interior of the tank, and being provided with a highlight formed by an elongate strip of reduced thickness compared with the remainder of the insert, said strip being oriented so that the surface of liquid in a tank extends transversely of the strip, and being dimensioned to permit the liquid level in the tank to be clearly viewed through the highlight.

2. A toilet as claimed in claim 1, wherein said insert is a plastic moulding and wherein said strip of reduced thickness is formed by a diametral groove at the side of the insert which is to be disposed at the interior of the tank.

3. A two-piece portable toilet which includes a bowl unit in the form of a tank defining a reservoir for flushing liquid and a bowl for receiving waste, and a holding tank for receiving waste from the bowl, wherein each said tank has an external wall which is provided with a liquid level indicator visible at the exterior of the toilet and comprising a sight gauge in the form of an at least partially transparent disc-shaped insert having a centre portion of a circular shape received in a complementary opening in a wall of the tank, and a surrounding flange sealed to said wall, said insert being positioned in the relevant wall at a height selected to correspond with a critical liquid level in the tank, said level corresponding with a level at which the tank should be refilled in the case of the flushing liquid reservoir and corresponding with the level at which the tank should be emptied in the case of the waste holding tank, each said insert being adapted to permit the level of liquid in the tank to be observed from externally of the toilet at said critical liquid level, and sufficiently in advance of said level to provide a user with a warning that the critical level is being approached, each said insert being provided with a highlight formed by an elongate strip of reduced thickness compared with the remainder of the insert, said strip being oriented so that the surface of liquid in a tank extends transversely of the strip, and being dimensioned to permit the liquid level in the tank to be clearly viewed through the highlight.

4. A toilet as claimed in claim 3, wherein said insert is a plastic moulding and wherein said strip of reduced thickness is formed by a diametral groove at the side of the insert which is disposed at the interior of the tank.

5. A toilet as claimed in claim 3, wherein at least one of the inserts forming a sight gauge is coloured to contrast with the insert forming the other sight gauge.

* * * * *